US010295960B2

(12) United States Patent
Kadmiri et al.

(10) Patent No.: US 10,295,960 B2
(45) Date of Patent: May 21, 2019

(54) STRIKING OR MUSICAL TIMEPIECE WITH A RESONANT BEZEL

(71) Applicant: Montres Breguet S.A., L'Abbaye (CH)

(72) Inventors: Younes Kadmiri, Morre (FR); Sylvain Marechal, Bois d 'Amont (FR); Stephane Cadau, Le Sentier (CH); Davide Sarchi, Renens (CH)

(73) Assignee: Montres Breguet S.A., L'Abbaye (CH)

( * ) Notice: Subject to any disclaimer, the term of this patent is extended or adjusted under 35 U.S.C. 154(b) by 114 days.

(21) Appl. No.: 15/415,113

(22) Filed: Jan. 25, 2017

(65) Prior Publication Data

US 2017/0269553 A1 Sep. 21, 2017

(30) Foreign Application Priority Data

Mar. 15, 2016 (EP) ..... 16160398

(51) Int. Cl.

| | |
|---|---|
| ***G04B 37/00*** | (2006.01) |
| ***G04B 21/08*** | (2006.01) |
| ***G04B 37/08*** | (2006.01) |
| ***G04B 45/00*** | (2006.01) |
| ***G10K 1/10*** | (2006.01) |
| ***G10K 1/26*** | (2006.01) |
| ***G04B 23/02*** | (2006.01) |

(52) U.S. Cl.

CPC ..... *G04B 37/0075* (2013.01); *G04B 21/08* (2013.01); *G04B 23/028* (2013.01); *G04B 37/08* (2013.01); *G04B 45/0069* (2013.01); *G10K 1/10* (2013.01); *G10K 1/26* (2013.01)

(58) Field of Classification Search

CPC .. G04B 37/0075; G04B 21/08; G04B 23/028; G04B 37/08; G04B 45/0069; G10K 1/10; G10K 1/26

USPC ..... 368/272

See application file for complete search history.

(56) References Cited

U.S. PATENT DOCUMENTS

| | | | | |
|---|---|---|---|---|
| 5,751,668 A * | 5/1998 | Eray | G04B 37/062 | 368/290 |
| 6,213,635 B1 * | 4/2001 | Savy | G04B 37/055 | 368/299 |
| 2016/0058375 A1 * | 3/2016 | Rothkopf | G06F 1/1643 | 600/301 |

FOREIGN PATENT DOCUMENTS

| | | |
|---|---|---|
| CH | 698 742 B1 | 10/2009 |
| EP | 2 328 044 A1 | 6/2011 |

OTHER PUBLICATIONS

European Search Report dated Sep. 9, 2016 in European Application 16160398.0, filed on Mar. 15, 2016 (with English Translation of Categories of cited documents and Written Opinion).

* cited by examiner

*Primary Examiner* — Edwin A. Leon
(74) *Attorney, Agent, or Firm* — Oblon, McClelland, Maier & Neustadt, L.L.P.

(57) ABSTRACT

A musical timepiece includes a gong fastened to a structure or a resonator of a watch case, the resonator rigidly assembled to the structure around a chamber, by lugs allowing vibration of the resonator within a determined frequency range, the chamber enclosing a sealing element forming with the lugs the only mechanical connection between the structure and the resonator. The structure or the resonator includes a groove receiving a gasket in contact with the structure and the resonator The structure structure or the resonator or the sealing element includes a rigid protruding relief portion compressing a gasket in its groove, with a hardness less than 20 Shore A, for minimum damping of the vibration of the resonator.

19 Claims, 5 Drawing Sheets

B-B

STRIKING OR MUSICAL TIMEPIECE WITH A RESONANT BEZEL

This application claims priority from European Patent Application No 16160398.0 of Mar. 15, 2016, the entire disclosure of which is hereby incorporated herein by reference.

FIELD OF THE INVENTION

The invention concerns a watch case comprising a rigid structure, and a resonator component arranged to be rigidly assembled, directly or indirectly, to said structure, said resonator component defining with said structure, when they are assembled to each other in an assembled operating position, a chamber that encloses, between said structure and said resonator component, at least one sealing element comprised in said watch case, said structure and/or said resonator component comprising a groove arranged to receive a gasket comprised in said sealing element, and to prevent the removal of said sealing element from said chamber in said assembled position.

The invention also concerns a musical timepiece comprising a striking-work or tune-playing mechanism arranged to cause to resonate at least one gong or one vibration plate affixed to said structure or to a resonator component of a case.

The invention concerns the field of striking or musical timepieces, such as minute-repeater watches, watches with an alarm function, music boxes and suchlike.

BACKGROUND OF THE INVENTION

In striking or musical timepieces, particularly minute-repeater watches, vibroacoustic improvements essentially concern the external elements allowing the sound level of the striking-work to be increased, but also the regulating elements, to limit the noise of the mechanism when the striking-work is released and thus to increase the emergence of sound produced by the striking-work, by increasing the ratio between the sound level of the striking-work and that of the noise of the mechanism.

As regards the external elements, radiating crystals or disassociated bezels can optimise the vibrational response of the external elements over a wide frequency band and thereby increase the sound level produced by the radiation of said elements. In order to have a high radiating power over a wide frequency band, the elements must be capable of vibrating freely, and independently of the excitation frequency to which they are subjected.

The vibrational amplitude of the external elements depends on good frequency tuning between the excitation frequency and that of the external elements, but also on good structure-borne sound transfer between the vibration generating element, such as a gong or similar, and a radiating element, such as a bezel/crystal assembly or a case back. The vibrations must therefore propagate easily without being attenuated by intermediate elements between the vibration generating element and the element intended to radiate, or by gaskets required for sealing the timepiece, which may prevent the radiating elements from vibrating freely.

CH Patent 698742B1 in the name of RICHEMONT discloses a device for connecting a striking-work gong to the crystal of a timepiece. The gong is integral with a heel portion secured by a screw to a part of the movement. This screw extends beyond the dial and rests via its end surface on the underside of an annular segment of an annular resilient component integral with the crystal. This annular resilient component has at least four annular segments, each having a rectilinear shape, seen in cross-section. The outer edge of the annular resilient component is intended to be clamped between a bezel and the middle of the timepiece case by means of a sealing gasket. The portion of the annular resilient component that is not underneath the crystal is housed entirely underneath the bezel.

EP Patent Application 2328044A1 in the name of ROLEX discloses a watch case comprising a middle part having at least one opening closed by a bezel and/or a crystal, or by a back cover. At least one of the elements closing the opening is connected to the case middle by a resilient metal member in the form of a ring or endless frame of hollowed cross-section, defined by the profile of a non-rectilinear wall, whose ends are joined to the periphery of the closure element, or respectively of the case middle. The profile of this non-rectilinear wall forms at least one annular fold of parallel orientation to the plane of the opening, this fold being produced by a curvature whose arc describes an angle comprised between 90° and 180°, to allow the closure element freedom of movement with respect to the plane of the opening.

SUMMARY OF THE INVENTION

The invention proposes to avoid the strong vibrational attenuation usually caused by the sealing gaskets for the external elements, and to allow some of the external elements, which are intended to radiate, to vibrate freely.

To this end, the invention concerns a watch case.

The invention also concerns a striking or musical timepiece according to claim 11.

BRIEF DESCRIPTION OF THE DRAWINGS

Other features and advantages of the invention will appear upon reading the following detailed description, with reference to the annexed drawings, in which.

Figure 8:
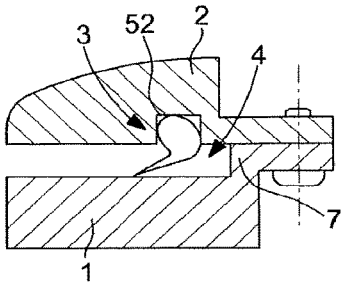
FIGS. 8 to 11 represent, like FIG. 6, different variants of mounting lugs between the bezel and the case middle.
Figure 9:
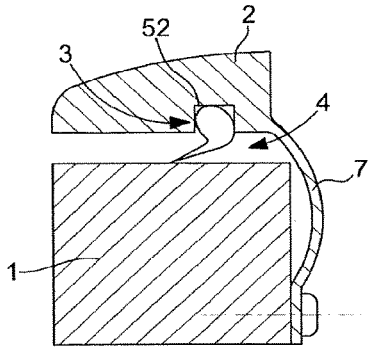
Figure 10:
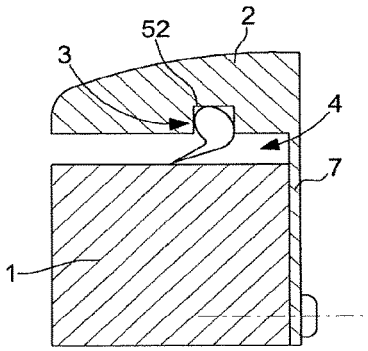
Figure 11:
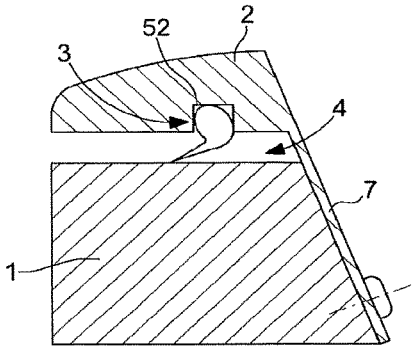

integral with the case middle and rigid in FIG. 8, integral with the bezel and very flexible in FIG. 9, integral with the bezel and parallel to the axial direction of the case in FIG. 10, integral with the bezel and oblique with respect to the axial direction of the case in FIG. 10.

Figure 12:
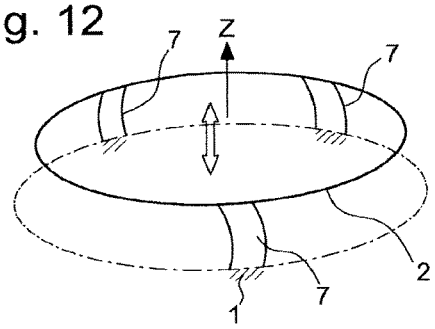
Figure 13:
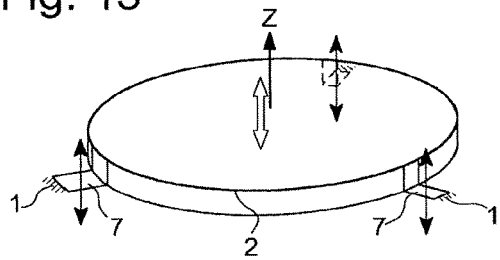
Figure 14:
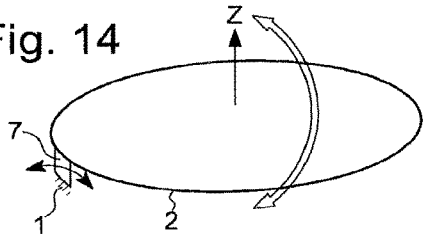
Figure 15:
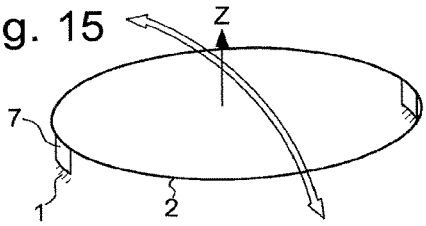

FIGS. 12 to 15 represent schematic and perspective views of the relative mobility of the bezel with respect to the case middle:

in piston mode with an axis parallel to that of the case, with three lugs parallel to the axis, in FIG. 12;

in piston mode with an axis parallel to that of the case, with three lugs perpendicular to the axis, in FIG. 13;

angular with the bezel cantilevered with respect to the end of a single lug, in FIG. 14;

pivoting about a yaw axis with respect to the ends of two opposite lugs in FIG. 15.

Figure 5:
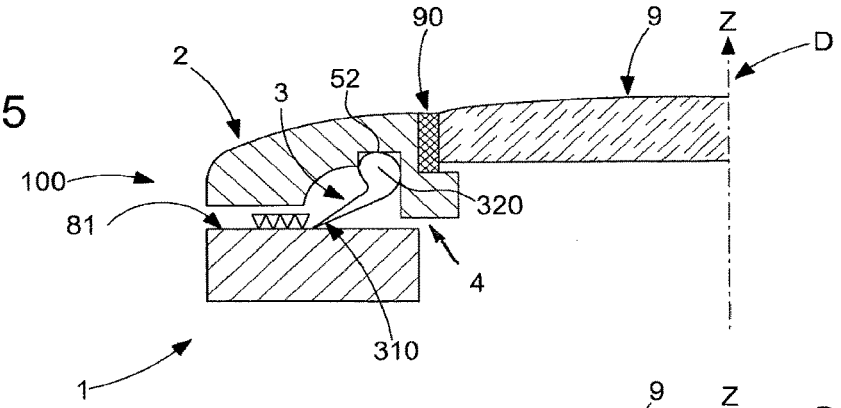
FIG. 5 shows, in a similar manner to FIG. 4, another variant of the shape of this gasket.
Figure 16:
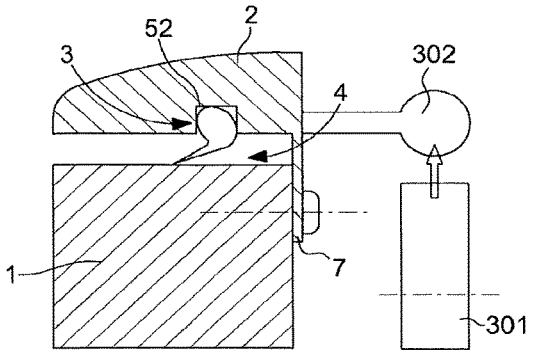

FIG. 16 represents the case of FIG. 5, in an area comprising a mounting lug between the case middle and the bezel which also carries a gong shown facing a hammer.

Figure 6:
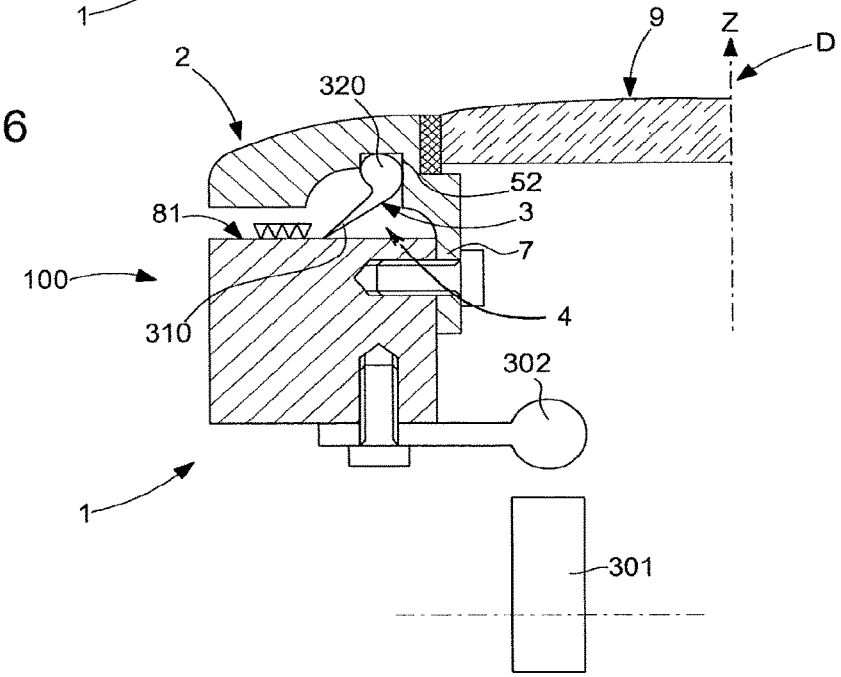
FIG. 6 represents the case of FIG. 5, in an area comprising a mounting lug between the bezel and the case middle which also carries a gong shown facing a hammer.
Figure 17:
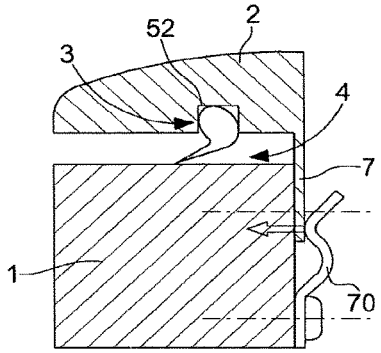

FIG. 17 represents, in a similar manner to FIG. 6, a variant wherein the mounting lug is not screwed in as in the other Figures, but held by a strong clamp.

Figure 18:
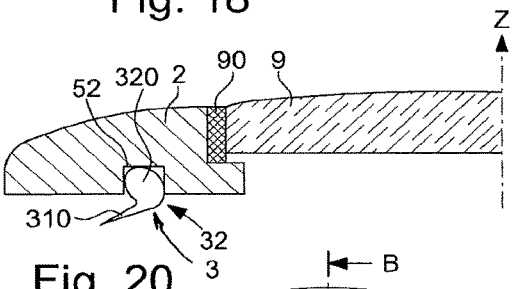
Figure 19:
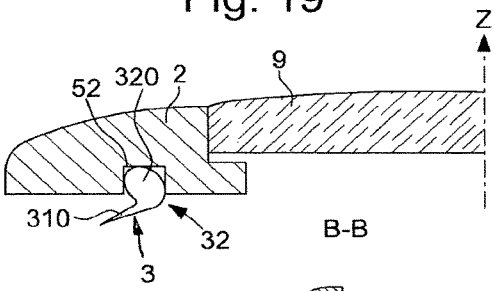
Figure 19:
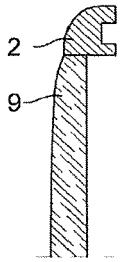
Figure 20:
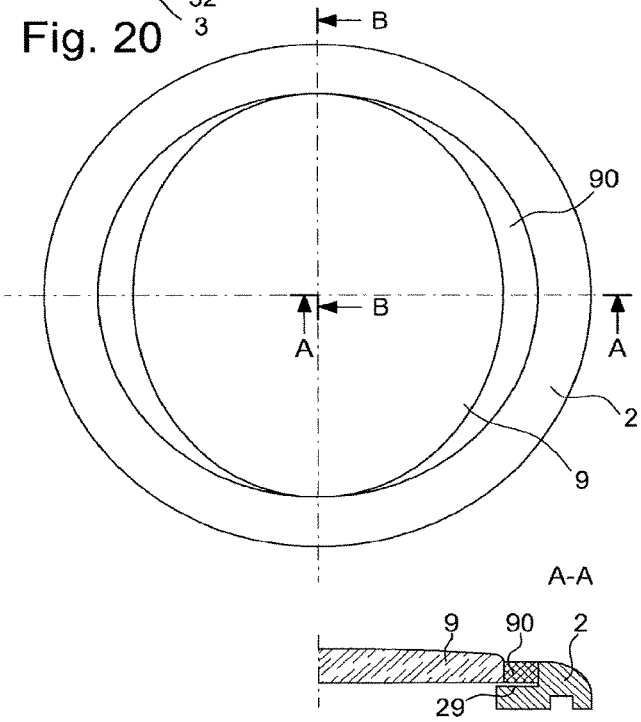

FIGS. 18 to 20 illustrate, in cross-sectional and top views, a crystal held diametrally at two opposite points of the bezel, directly on the latter, whereas on the rest of its periphery the crystal and the bezel are joined by a bezel gasket.

Figure 2:
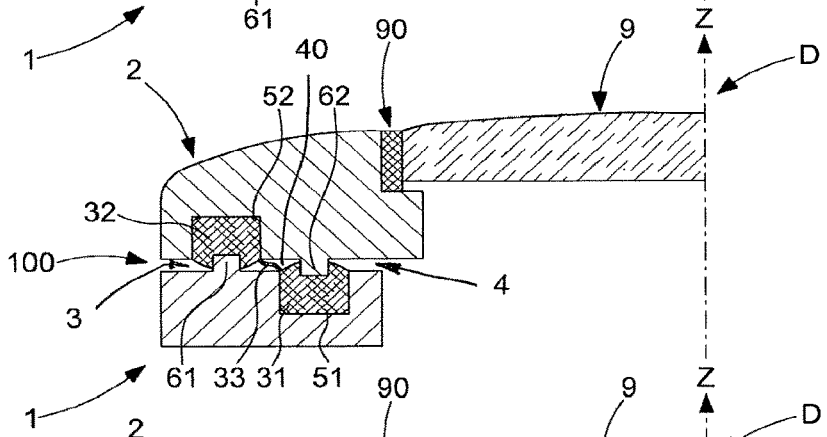
FIG. 2 represents, in a similar manner to FIG. 1, a variant with a sealing element comprising two such gaskets, each housed inside a groove of one of the components, and connected by a flexible membrane.
Figure 7:
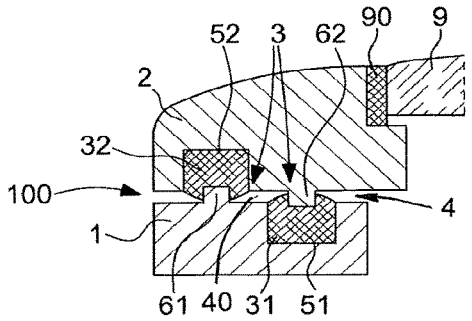
FIG. 7 represents a similar variant to that of FIG. 1, wherein two grooves made on two different diameters of the case each contain one such gasket.
Figure 21:
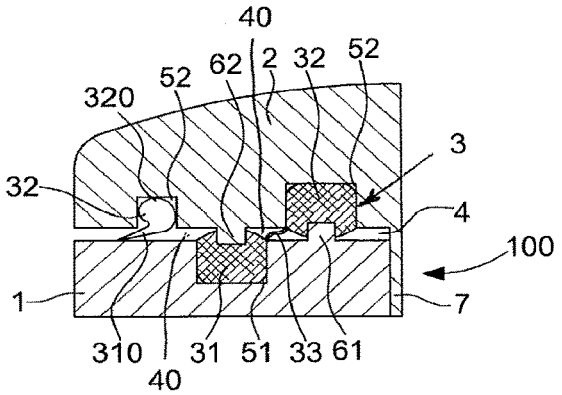

FIG. 21 represents a similar variant to that of FIG. 7, wherein three grooves made on three different diameters of the case each contain a gasket: the outermost contains a gasket according to FIG. 5, and the two innermost a sealing element with two gaskets according to FIG. 2.

Figure 22:
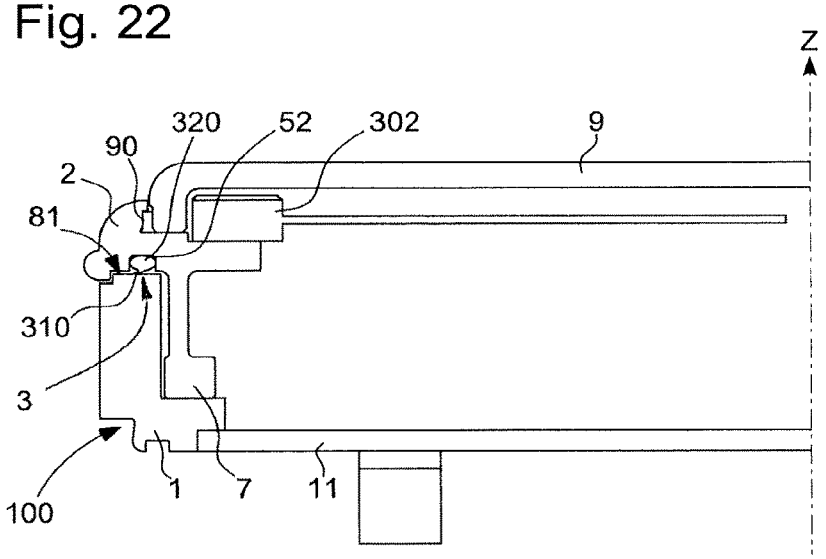

FIG. 22 represents a similar variant to that of FIG. 16.

Figure 23:
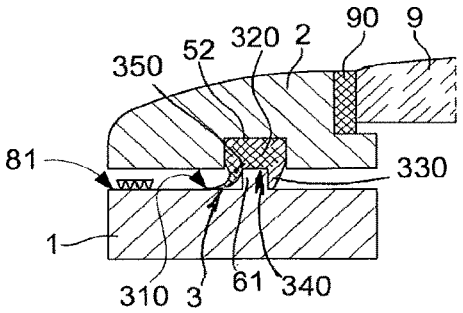

FIG. 23 represents an advantageous variant of a gasket arranged to be pressed into its groove housing by an opposing projecting element when the case is assembled, the gasket comprising, on the external side of the case, a thin lip, bearing here on a flat surface of the case middle, devised to be pressed further onto this flat surface when subjected to a high external pressure.

Figure 24:
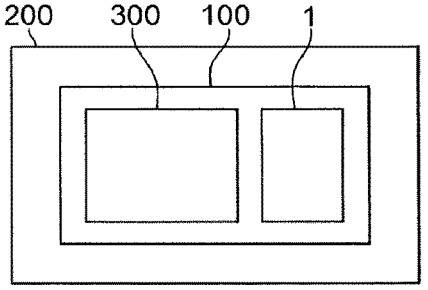

FIG. 24 is a block diagram representing a timepiece, particularly a watch, comprising a striking-work or tune-playing mechanism arranged to cause to resonate a gong or a vibration plate fastened to such a case.

DETAILED DESCRIPTION OF PREFERRED EMBODIMENTS

The invention proposes to make a timepiece comprising sound transmission means enclosed inside a case, and means for radiating the sound vibration towards the user, using some of the elements of the timepiece exterior, while restricting to a maximum the strong vibrational attenuations usually caused by the sealing gaskets of the timepiece exterior, in order to allow those elements of the exterior that are intended to radiate, called here the "radiating element", to vibrate freely.

In order for the vibroacoustic system formed by the vibration generating element and the radiating element to be efficient, it is important for the radiating element to be able to vibrate freely in its natural vibration modes, which are mainly defined by its fastening system. To prevent the vibrations propagating to the rest of the timepiece exterior, it is important for the contact between the radiating element and the most rigid part of the case, notably a case middle, to be minimal. However, this type of exterior runs counter to a water-resistant construction. The invention optimises the transfer of vibrations, while ensuring the sealing of the timepiece.

The invention is described and illustrated in the particular and non-limiting case of a striking watch. It is directly applicable to a musical watch, to a music box, or other similar timepieces.

In the case of a watch, the assembly formed by the case middle and the back cover is the most rigid element, and is in direct contact with the user. The radiating element is, generally speaking, preferably located opposite the back cover, and advantageously includes at least the bezel or the crystal.

The invention is described for a watch case 100 comprising a rigid structure in turn comprising a middle part. A bezel which, in a conventional manner, carries a crystal, is fastened to this middle part. Those skilled in the art will have no difficulty in transposing this embodiment to a musical watch or similar.

Thus, the invention concerns a watch case 100 comprising a rigid structure 1, and at least one resonator component 2. This at least one resonator component 2 is arranged to be rigidly assembled, directly or indirectly, to structure 1.

Preferably, resonator component 2, even if it comprises a membrane or a component intended to vibrate, comprises at least one part of similar stiffness to that of structure 1, and the fastening is achieved on these rigid parts of resonator component 2 and of structure 1.

Resonator component 2 defines with structure 1, when they are assembled to each other in an assembled operating position, a chamber 4 which encloses, between structure 1 and resonator component 2, at least one sealing element 3 comprised in this watch case 100. This chamber 4 encircles watch case 100. It has a height corresponding to a sufficient end play value J to allow unimpeded vibration at full amplitude of resonator component 2 with respect to structure 1.

Structure 1 and/or resonator component 2 comprises a groove 51, 52 which is arranged to receive a gasket 31, 32, comprised in sealing element 3, and to prevent the removal of sealing element 3 from chamber 4 in the assembled position.

This sealing element 3 must answer an a priori contradictory problem: not to form an impediment to the vibrations of resonator component 2, and to ensure the conventional sealing of a watch under several thousand hectopascals, against water and dust and suchlike. In an advantageous embodiment, sealing element 3 includes at least one gasket 31, 32, whose deformed shape under such external pressure is different from its shape at rest under normal atmospheric pressure. Preferably, this gasket comprises at least one lip 310, which is thinner than the body of the more solid gasket 320, which is used for holding the gasket inside a groove or a housing, said thin lip 310 bears on a flat surface 81, 82, onto which it is pressed further, the higher the external pressure.

According to the invention, watchcase 100 includes at least one protruding relief portion 61, 62, 63, forming part of structure 1 and/or of resonator component 2 and/or of sealing element 3.

More particularly at least structure 1 or resonator component 2 comprises such a protruding portion 61, 62.

More particularly this at least one protruding relief portion 61, 62, 63 is rigid, and which is arranged, in the assembled position, to exert a compression force on at least one gasket 31, 32, facing a median area of the groove 51, 52, which receives gasket 31, 32. Thus, when resonator component 2 is assembled on structure 1, sealing element 3 is compressed between them, and each protruding relief portion compresses a gasket inside a groove, thereby sealing case 100. This manner of assembling a sealing element is unusual, since the grooves usually serve to hold one part of a gasket that has a surface opposite the groove which bears on a smooth opposing surface. Moreover, it is generally sought to avoid the risk of damaging a gasket by pressure on a protruding element.

Therefore, within the scope of the invention, a silicone or similar gasket is preferably chosen, with a very low Shore hardness, preferably less than or equal to 20 Shore A.

Thus, sealing element 3 advantageously includes at least one gasket 31, 32, with a hardness less than or equal to 20 Shore A.

More particularly, each gasket 31, 32 comprised in sealing element 3 has a hardness less than or equal to 20 Shore A.

The system of mechanical fastening between structure 1 and resonator component 2, notably by at least one lug 7, leaves an end play J between structure 1 and resonator component 2. The loss of sealing resulting from end play J required for optimum vibration is thus offset by this particular sealing element 3 according to the invention.

In a particular embodiment, for example as seen in FIG. 2, 7 or 21, watch case 100 comprises several sealing elements 3, one inside the other, delimiting at least one sealed intermediate volume 40.

Naturally, protruding relief portion 61, 62, 63 is devoid of sharp edges and preferably has a curved profile to avoid damaging the gasket. Once mounted, sealing gasket 3 is no longer subjected to any actual motion; its function is to ensure the sealing of the interior of case 100, in particular when resonator component 2 vibrates, this vibration occurring within a well-defined maximum amplitude. Each gasket 31, 32, comprised in sealing element 3, can therefore tolerate this vibration and ensure perfect sealing at all times.

Protruding relief portion 61, 62, can be manufactured integrally with structure 1 or resonator component 2, but it may also be added to one of the latter. In this regard, protruding relief portion 61, 62, 63 may be stiff or elastic, but in the latter case is at least ten times less deformable than the gasket concerned, with equal compression.

In a preferred implementation, and as seen in the Figures, resonator component 2 tends to vibrate along an axis Z substantially perpendicular to the bearing surfaces of gasket or gaskets 31, 32, opposite groove or grooves 51, 52, in a resonance mode called the "piston" mode. Each gasket 31, 32 is thus only stressed in that direction, and with a very restricted amplitude, less than 0.10 mm and usually on the order of a hundredth of a millimeter.

Figure 1:
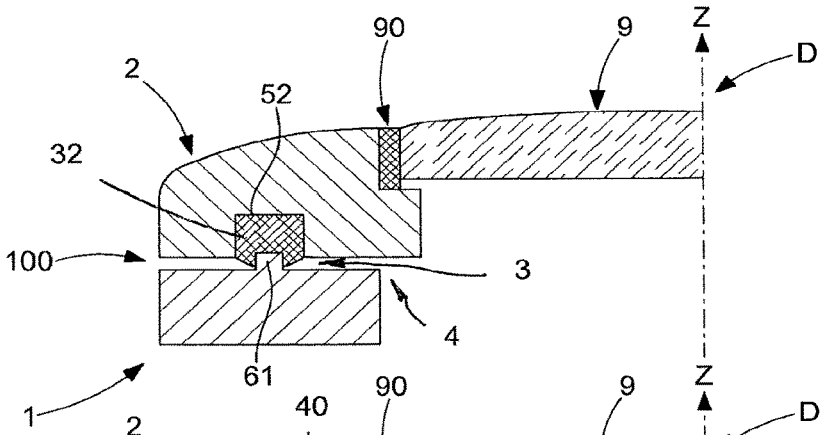
FIG. 1 represents a schematic, cross-sectional view of one portion of a striking watch case according to the invention, comprising a bezel carrying a crystal, and attached to a middle part enclosing a special silicone gasket compressed in a groove by an opposing projecting element.

In a first variant, as seen in FIG. 1, sealing element 3 includes a single gasket 31, 32, structure 1 or respectively resonator component 2, includes one groove 51, 52, and resonator component 2, or respectively structure 1, includes one protruding relief portion 62, 61. Naturally, this first variant can be extrapolated to a variant of which an example is illustrated in FIG. 7, wherein sealing element 3 includes several gaskets 31, 32, independent of each other, and one inside the another, i.e. they have different radii, and structure 1 or resonator component 2 include such grooves 51, 52, and opposing protruding relief portions 61, 62, so that each of these gaskets is compressed by a protruding relief portion towards the bottom of its respective receiving groove, during the relative assembly of structure 1 or resonator component 2.

In a second variant, as seen in FIG. 2, structure 1 includes a first groove 51 and resonator component 2 includes a second groove 52 remote from first groove 51. Sealing element 3 includes, integral with each other, at least a first gasket 31 and a second gasket 32 remote from each other and connected to each other by a sealed membrane 33 extending between first groove 51 and second groove 52. In a similar manner to above, structure 1 includes a first protruding relief portion 61 arranged to cooperate with second gasket 32 opposite second groove 52, and resonator component 2 includes a second protruding relief portion 62 arranged to cooperate with first gasket 31 opposite first groove 51. The sealing is thus three-fold: provided by each of gaskets 31, 32 in an opposing manner, and by membrane 33.

Figure 3:
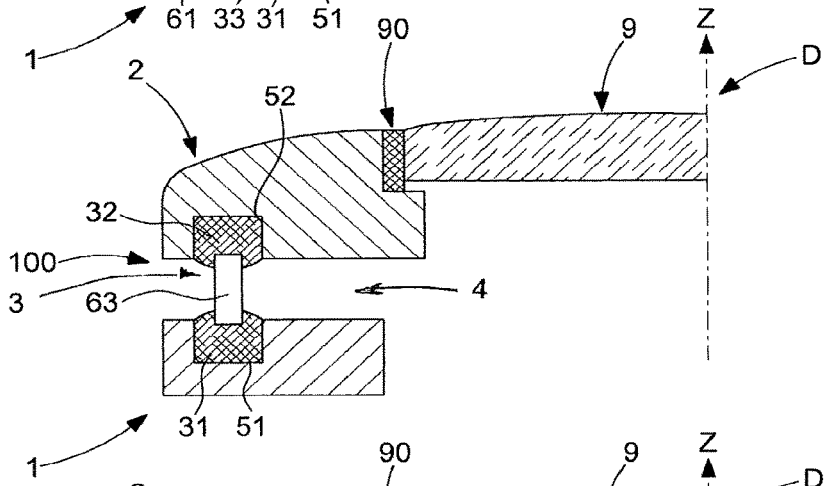
FIG. 3 represents, in a similar manner to FIG. 1, another variant with a sealing element comprising two such gaskets, each housed inside a groove of one of the components, and connected by an element that is stiffer than each of the latter, and which compresses each gasket in its respective groove.

In a third variant, as seen in FIG. 3, structure 1 includes a first groove 51, and resonator component 2 includes a second groove 52 substantially opposite first groove 51. Sealing element 3 includes at least a first gasket 31 and a second gasket 32 remote from each other and connected to one another by a third rigid protruding relief portion 63. This third rigid protruding relief portion 63 is arranged to cooperate both with first gasket 31 opposite first groove 51 and with second gasket 32 opposite second groove 52. Sealing element 3 can be achieved by overmoulding a third rigid protruding relief portion 63, for example made of hard plastic material, with a silicone coating forming first gasket 31 and second gasket 32. The third rigid protruding relief portion 63 may consist of a stiff ring held and sandwiched by silicone gaskets 31 and 32, which are moulded and deposited inside grooves 51 and 52. This ring does not touch either structure 1 or resonator component 2 to avoid any rigid contact. The ring may also take the form of a truncated cone, tilted with respect to axial axis Z of case 100.

The Figures illustrate a preferred variant wherein each protruding relief portion 62, 61 is a closed rib, whose shape conforms to that of case 100.

In these variants, protruding relief portion 62, 61 is integral with structure 1 or respectively resonator component 2, and is either welded or brazed or machined directly to the element concerned.

It will be noted also that sealing element 3, or one of gaskets 31, 32 comprised therein, is not necessarily an added element, and may be made of silicone directly moulded inside the appropriate groove.

Figure 4:
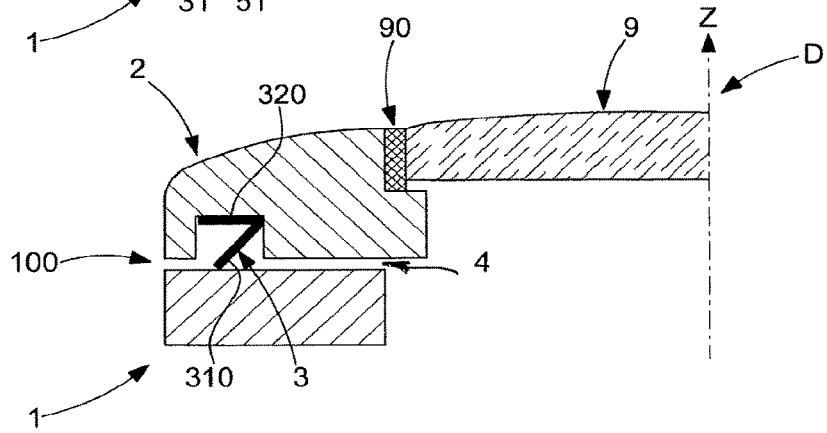
FIG. 4 represents, in a similar manner to FIG. 1, a variant of a gasket made of the same special silicone comprising a lip that is thin with respect to a more solid body housed inside a groove.

FIGS. 4 to 6 illustrate another mode of manufacturing such a case 100, wherein structure 1 or resonator component 2 includes a flat surface 81, 82, and wherein the opposing component includes, held inside a groove 51, 52, the part of greatest cross-section 320 of a substantially conical gasket that gradually thins out towards a lip 310 of smaller cross-section, which cooperates with this opposing flat surface 81, 82. Here too, the gasket is almost static and has the function of preventing the ingress of water and dirt, while allowing resonator component 2 to vibrate as freely as possible. And, preferably, this gasket is also made of silicone or similar, with a very low Shore hardness, preferably less than or equal to 20 Shore A.

The mechanical connection between structure 1 and resonator component 2 may be achieved in different ways. Preferably, this connection is substantially isolated, such that most of resonator 2 can vibrate as freely as possible between two rigid connections. FIGS. 6 to 17 illustrate, in a non-limiting manner, a connection via lugs, integral with structure 1 and/or with resonator component 2. Thus, in a particular variant, structure 1 or resonator component 2 includes at least one lug 7 for the rigid and direct fastening thereof to resonator component 2 or respectively to structure 1. More particularly, the mechanical connection achieved by the rigid fastening between resonator component 2 and structure 1 includes three lugs 7.

These lugs 7 may be screwed in to allow for disassembly, or pressed in, welded, brazed, etcetera. FIG. 17 illustrates a particular variant wherein one lug 7 is fixedly held by a spring 70 allowing for easy disassembly. Naturally, there is then a means for limiting the travel between structure 1 and resonator component 2, via a screw or similar. FIGS. 8 to 11 illustrate different variants of lugs 7, which are more or less stiff, or conversely elastic.

FIG. 6 represents a gong 302 fastened to case middle 1, struck by a hammer 301, whereas FIGS. 16 and 22 represent such a gong integrally mounted with bezel 2: upon activation of this vibration generating element, by a hammer, a drum or other element, the vibrations propagate straight to the bezel/crystal assembly. FIG. 22 illustrates the particular case wherein case 100 includes 3 gold lugs, having a width equal to 3.8 mm, a height equal to 2.9 mm and a thickness equal to 0.6 mm. In this embodiment, bezel 2 carries a gong 302, seen through crystal 9.

In a particular embodiment of a watch case 100, and as illustrated by the Figures, structure 1 is a case middle, notably fastened to a back cover 11, and resonator component 2 is a bezel carrying a crystal 9, directly or via a crystal gasket 90. In this regard, in the variant comprising a crystal gasket 90, for crystal 9 to resonate in the best conditions, the material of crystal gasket 90 is chosen in accordance with the same criteria as the gasket or gaskets of sealing element 3, in particular, made of silicone or similar, with a very low Shore hardness, preferably lower than or equal to 20 Shore A.

FIGS. 12 and 13 illustrate a vibration of bezel 2 with respect to case 1 in piston mode, in axial direction Z, in the first case with three lugs 7 substantially parallel to axis Z and which work by buckling or by elongation and in the second case with three lugs 7 perpendicular to axis Z that work by bending.

FIG. 14 illustrates bezel 2 held by a single lug 7, parallel to axis Z, fastened to case middle 1; bezel 2 is then cantilevered and oscillates angularly.

FIG. 15 illustrates bezel 2 held by 2 two lugs 7, parallel to axis Z, fastened to case middle 1 and substantially diametrically opposite, the bezel then tends to pivot about a yaw axis between the ends of these two lugs 7.

It is understood that the fastening of crystal 9 with respect to bezel 2 can be achieved in accordance with similar variants, and that resonance can thus combine:

a vibration of bezel 2 with respect to case middle 1, and a vibration of crystal 9 with respect to bezel 2.

For example, FIGS. 18 to 20 illustrate crystal 9 held diametrally at two opposite points of bezel 2, directly on the latter, whereas on the rest of its periphery the crystal and the bezel are joined by a bezel gasket.

FIG. 23 represents an advantageous variant of a gasket, devised to be pressed into its groove housing 52 by an opposing protruding element 61 when the case is assembled, the gasket comprising, on the external side of the case, a thin outer lip 310, bearing here on a flat surface 81 of case middle 1, devised to be pressed further onto this flat surface 81 when subjected to a high external pressure. When case 100 is closed, the compression of this gasket via protruding element 61, 62 forces thin lip 310 to bear on flat surface 81, 82, by a tilting effect. This bearing is then reinforced by the exertion of external pressure. More particularly, this gasket includes a second inner lip 330, placed on a smaller diameter than that of outer thin lip 310, and which protrudes from the same side (with respect to a plane perpendicular to the axis of the case) as thin lip 310, with respect to an area of greater cross-section 320 calculated to occupy the entire volume of the corresponding groove 52 and whose profile of substantially homothetic shape to the profile of groove 52 ensures an orientation of thin lip 310 such that the latter bears on the corresponding flat surface 81, and which delimits with base portion 350 of thin lip 310 a substantially annular volume 340, arranged to cover an opposing protruding element 61, 62, and more particularly still the width of this annular volume 340 in the free state of the gasket, measured on a radial line with respect to the axis of case 100, is smaller than the width of the protruding element 61, 62, for which the gasket is more particularly devised. More particularly, the area of greater cross-section 320 is annular with straight edges, to cooperate with a groove 52 with straight edges, and volume 340 is a rotationally symmetrical groove with straight edges, to cooperate with a protruding element 61 with straight edges. The gasket is a closed, substantially toroidal, or rotationally symmetrical gasket in the free state.

The invention also concerns a musical timepiece 200, i.e. with a sound, striking, alarm, music box or similar mechanism. This timepiece 200, particularly a watch, includes a striking-work or tune-playing mechanism 300 arranged to cause to resonate, for example via a hammer 301, a pin cylinder, or other similar means, at least one gong 302 or a vibration plate fastened to a structure 1 or to a resonator component 2 of a case 100.

According to the invention, resonator component 2 is arranged to be rigidly assembled to structure 1, by at least one lug 7 allowing vibration of resonator component 2 within a determined frequency range. Resonator component 2 defines with structure 1, when they are assembled to each other in an assembled operating position, a chamber 4 which encloses at least one sealing element 3 between structure 1 and resonator component 2. This sealing element 3 on the one hand, and on the other hand the lug, or the at least one lug 7 form the only mechanical connection between structure 1 and resonator component 2. Sealing element 3 includes one or more gaskets 31, 32, in contact with structure 1 and resonator component 2, and all the gaskets 31, 32, have a hardness less than or equal to 20 Shore A, for minimum damping of the vibration of resonator component 2. More particularly, these gaskets are made of silicone.

In a first embodiment, timepiece 200 includes a case 100, which is a watch case according to any of the variants of FIGS. 1 to 3 set out above.

In a second embodiment, at least structure 1 or resonator component 2 includes a groove 51, 52, which is arranged to receive a part of greater cross-section 320, of a gasket 31, 32, comprised in sealing element 3, as seen in FIG. 4 or 5. Structure 1, or respectively resonator component 2, then includes one such groove 51, 52, and resonator component 2, or respectively structure 1, includes, substantially opposite groove 51, 52, a flat surface 82, 81 on which bears, in an assembled position, a lip of smaller cross-section 310, of gasket 31, 32. Gasket 31, 32 is of substantially conical shape, and closes chamber 4 with the lip of smaller cross-section 310, which is disposed further outside watch case 100 than the part of greater cross-section 320, like a lip seal in an automotive transmission.

The relative fastening between structure 1 and resonator component 2 can be achieved in the manner described above with one or more lugs 7, and the entire description relating to watch case 100 is applicable to this timepiece 200.

Naturally the first embodiment and the second embodiment can be combined, as in the example of FIG. 21. Watch case 100 then includes several sealing elements 3, one inside the other, and delimiting at least one intermediate sealed volume 40. And, more particularly, a sealing element cooperating with a protruding element 61, 62, is located further inside watch case 100 than a sealing element with a conical gasket and a thin lip.

The vibroacoustic system according to the invention is efficient, since the radiating element, here resonator component 2, can vibrate freely in its natural vibration modes. The contact between the bezel and the case middle is minimal, owing to a design with a bezel fastened to a rigid case middle by lugs or similar means, avoiding direct contact with the bezel over the entire periphery of the case.

The invention can be used with an external element manufactured by electroforming, where, because of the very thin structure of this type of component, a gasket is required in order to resist water pressure without ruining the actual component. In particular, an electroformed bezel or case middle made of gold alloy is well suited to implementation of the invention.

In short, the invention concerns a particular assembly of at least three components of a watch exterior, wherein:

two components are formed by two rigid solid volumes forming part of the watch case, such as, for example, a bezel and a case middle, a back cover and a case middle, a bezel and a crystal, a back cover and a crystal, a back cover and a bezel;

at least one component is a sealing element including at least one gasket capable of high deformation during the casing operation, for example a silicone gasket with a very low Shore hardness.

at least one of the two rigid solid volumes has a groove on the surface which opposes the surface of the other solid volume during casing;

one component having the shape of the case, which may be inscribed inside a volume of revolution having a diameter corresponding to the diameter of the two solid volumes, and which is stiff or elastic, but which, if it is elastic, is at least ten times less deformable than the gasket concerned with equal compression.

The invention provides significant advantages:

limiting vibrational losses in the sealing means required between a vibrating element intended to radiate and the structure of the watch case or suchlike;

reducing damping of vibrations, which results in greater sound persistence.

improving the acoustic performance of a timepiece exterior enjoying this type of solution.

The invention claimed is:

1. A watch case comprising:

a rigid structure, and at least one resonator component arranged to be rigidly assembled, directly or indirectly, to said structure, said resonator component defining with said structure, when the latter are assembled to each other in an assembled operating position, a chamber which encloses, between said structure and said resonator component, at least one sealing element comprised in said watch case to prevent removal of said sealing element from said chamber in the assembled operating position, wherein said sealing element includes a gasket, wherein said structure or respectively said resonator component comprising a groove arranged to receive the gasket, and wherein said resonator or respectively said structure includes a planar face and at least one rigid protruding relief portion surrounded by the planar face and protruding toward said groove in structure or respectively said resonator, said at least one protruding portion being arranged, in said assembled position, to exert a compression force on said gasket opposite a median area of said groove which receives said gasket.

2. The watch case according to claim 1, wherein said sealing element comprises only one of said gasket.

3. A watch case comprising:

a rigid structure, and at least one resonator component arranged to be rigidly assembled, directly or indirectly, to said structure, said resonator component defining with said structure, when the latter are assembled to each other in an assembled operating position, a chamber which encloses, between said structure and said resonator component, at least one sealing element comprised in said watch case wherein said watch case includes at least one rigid protruding relief portion arranged, in said assembled position, to exert a compression force on a gasket opposite a median area of a groove which receives said gasket, said at least one protruding relief portion forming part of said structure or of said resonator component or of said sealing element, and wherein said structure comprises a first groove and said resonator component comprises a second groove remote from said first groove, wherein said sealing element comprises at least a first gasket and a second gasket remote from each other and connected to each other by a sealed membrane extending between said first groove and said second groove, and wherein said structure includes a first protruding relief portion arranged to cooperate with said second gasket opposite said second groove, and said resonator component includes a second protruding relief portion arranged to cooperate with said first gasket opposite said first groove to prevent removal of said sealing element from said chamber in said assembled operating position.

4. The watch case according to claim 1, wherein said sealing element includes at least one said gasket of hardness less than or equal to 20 Shore A.

5. The watch case according to claim 4, wherein each gasket comprised in said sealing element has a hardness less than or equal to 20 Shore A.

6. The watch case according to claim 1, wherein said watch case comprises several said sealing elements, one inside the other, delimiting at least one sealed intermediate volume.

7. The watch case according to claim 1, wherein said sealing element includes at least one said protruding relief portion.

8. A watch case, comprising:

a rigid structure, and at least one resonator component arranged to be rigidly assembled, directly or indirectly, to said structure, said resonator component defining with said structure, when the latter are assembled to each other in an assembled operating position, a chamber which encloses, between said structure and said resonator component, at least one sealing element comprised in said watch case wherein said structure comprises a first groove and said resonator component comprises a second groove substantially opposite said first groove, wherein said sealing element comprises at least a first gasket and a second gasket remote from each other, and wherein said sealing element includes a rigid protruding relief portion arranged to connect the first gasket and the second gasket and to cooperate both with said first gasket opposite said first groove and with said second gasket opposite said second groove to prevent removal of said sealing element from said chamber in said assembled operating position.

9. A watch case, comprising:

a rigid structure, and at least one resonator component arranged to be rigidly assembled, directly or indirectly, to said structure, said resonator component defining with said structure, when the latter are assembled to each other in an assembled operating position, a chamber which encloses, between said structure and said resonator component, at least one sealing element comprised in said watch case and including a gasket, at least said structure or said resonator component comprising a groove arranged to receive the gasket, and to prevent removal of said sealing element from said chamber in said assembled operating position, wherein said watch case includes at least one rigid protruding relief portion arranged, in said assembled position, to exert a compression force on said gasket opposite a median area of said groove which receives said gasket, said at least one protruding relief portion forming part of said structure or of said resonator component or of said sealing element, and wherein said structure or said resonator component includes at least one lug for the rigid and direct fastening thereof to the resonator component or respectively to the structure.

10. The watch case according to claim 9, wherein the rigid fastening between said resonator component and said structure includes three lugs.

11. The watch case according to claim 1, wherein said structure is a case middle and wherein said resonator component is a bezel carrying a crystal.

12. A musical timepiece comprising:

a striking-work or tune-playing mechanism arranged to cause to resonate at least one gong or one vibration plate fastened to a structure or to a resonator component of a case, wherein said resonator component is arranged to be rigidly assembled to said structure, by at least one lug allowing vibration of said resonator component within a determined frequency range, said resonator component defining with said structure, when the latter are assembled to each other in an assembled operating position, a chamber that encloses at least one sealing element between said structure and said resonator component, said sealing element and said at least one lug forming the only mechanical connection between said structure and said resonator component, said sealing element including one or more gaskets in contact with said structure and said resonator component, and said one or more gaskets having a hardness less than or equal to 20 Shore A, for minimum damping of the vibration of said resonator component.

13. The timepiece according to claim 12, wherein said case is a watch case.

14. The timepiece according to claim 13, wherein at least said structure or respectively said resonator component includes a groove arranged to receive a part of greater cross-section of a gasket comprised in said sealing element, and wherein said resonator component or respectively said structure includes, substantially opposite said groove, a flat surface on which bears, in said assembled position, a lip of smaller cross-section of said gasket, said gasket being of substantially conical shape, and closing said chamber with said lip of smaller cross-section, disposed further outside said watch case than said part of greater cross-section.

15. The timepiece according to claim 12, wherein said resonator component includes three lugs for the rigid and direct fastening thereof to said structure.

16. The timepiece according to claim 12, wherein said structure is a case middle and wherein said resonator component is a bezel carrying a crystal.

17. The timepiece according to claim 13, wherein said watch case comprises several said sealing elements, one inside the other, delimiting at least one sealed intermediate volume.

18. The timepiece according to claim 16, wherein said case is a watch case that comprises at least one sealing element internal to a sealing element, together delimiting a sealed intermediate volume.

19. The watch case according to claim 1, wherein said groove is wider than said protruding portion.

* * * * *